US012345049B2

(12) United States Patent
Sutton et al.

(10) Patent No.: US 12,345,049 B2
(45) Date of Patent: Jul. 1, 2025

(54) DOWNSPOUT WITH DEBRIS TRAP

(71) Applicant: Englert, Inc., East Brunswick, NJ (US)

(72) Inventors: Edward Sutton, East Brunswick, NJ (US); Amin Jasani, Fords, NJ (US); Angel G. Martinez, Jr., North Plainfield, NJ (US)

(73) Assignee: Englert, Inc., East Brunswick, NJ (US)

( * ) Notice: Subject to any disclaimer, the term of this patent is extended or adjusted under 35 U.S.C. 154(b) by 134 days.

(21) Appl. No.: 17/736,227

(22) Filed: May 4, 2022

(65) Prior Publication Data

US 2023/0358050 A1 Nov. 9, 2023

(51) Int. Cl.
*E04D 13/08* (2006.01)

(52) U.S. Cl.
CPC ..... *E04D 13/08* (2013.01); *E04D 2013/086* (2013.01); *E04D 2013/0866* (2013.01)

(58) Field of Classification Search
CPC . E04D 13/0767; E04D 13/0641; E04D 13/08; E04D 2013/086
USPC ..... 138/41; 52/12, 16; 210/170.03, 459, 210/433.1, 162, 248
See application file for complete search history.

(56) References Cited

U.S. PATENT DOCUMENTS 2,090,997 A * 8/1937 French ..... E04D 13/08 210/433.1
2,419,501 A * 4/1947 Pinto ..... E04D 13/08 210/446
4,470,908 A * 9/1984 Odekirk ..... B01D 35/00 210/463
4,801,377 A * 1/1989 Bolt ..... B01D 29/945 52/12
5,230,798 A * 7/1993 Rogman ..... B01D 29/96 52/12
5,709,051 A * 1/1998 Mazziotti ..... E04D 13/08 52/12
8,006,720 B1 * 8/2011 Kotansky ..... E04D 13/08 52/16
8,475,654 B1 * 7/2013 Smith ..... E04D 13/08 210/170.03
8,656,947 B1 * 2/2014 Barton ..... E04D 13/08 210/170.03
9,416,543 B1 8/2016 Fox et al.
2003/0167700 A1 * 9/2003 Esmond ..... E04D 13/08 52/12
2005/0246967 A1 * 11/2005 Esmond ..... E04D 13/08 52/16

(Continued)

*Primary Examiner* — Patrick F Brinson
(74) *Attorney, Agent, or Firm* — Powley & Gibson, P.C.

(57) ABSTRACT

A debris trap for a downspout comprises an angled grate, a baffle, and a cover piece. The downspout has an opening with a vertical extent and a horizontal extent. The angled grate has holes to enable fluid to flow through the angled grate and the angled grate can be secured to the inside of the downspout. The baffle can be secured above the vertical extent of the opening, extend partially behind the opening, and angle inward to direct fluid toward the rear of the angled grate. The cover piece can comprise a top flange configured to removably secure between the baffle and the downspout and a bottom flange configured to contact the angled grate and/or a portion of the downspout below the vertical extent of the opening. The debris trap can prevent debris from clogging the downspout.

20 Claims, 3 Drawing Sheets

(56) References Cited

U.S. PATENT DOCUMENTS

| | | | | |
|---|---|---|---|---|
| 2016/0194879 | A1* | 7/2016 | Gleason | E04D 13/0645 52/16 |
| 2023/0302385 | A1* | 9/2023 | Sherwood | B01D 29/96 |

* cited by examiner

DOWNSPOUT WITH DEBRIS TRAP

TECHNICAL FIELD

This disclosure relates to rain gutters, and in particular, to downspouts.

BACKGROUND

Gutter systems can include gutters and downspouts that can be used to collect and divert fluid (e.g., rainwater) away from building structures. Gutters are typically open channel devices attached to building structures adjacent to a roof edge to collect rainwater deposited on the roof. Downspouts are typically closed conduits that can divert rainwater collected from a gutter on the building structures to the ground and/or into an underground water storage and drainage system. Gutters are often exposed to loose debris. The rainwater introduced into the gutters and directed through the downspout can often contain debris such as leaves, sticks, and other debris that have accumulated on the roof and are subsequently washed into the gutter.

Debris can often accumulate and clog the downspout and/or an underground water storage and drainage system that may be connected to the downspout. Clogging of the downspout and/or the underground water storage and drainage system can prevent the downspout from directing the rainwater away from the building structure and can cause damage. For example, a clogged downspout may cause the rainwater to back up within the downspout and overflow the edges of the gutters along the walls of the building, thereby damaging or defacing the building structure. A clogged underground water and drainage system can be difficult to clear, cause overflow, and prevent proper function of the gutter system.

SUMMARY

The present disclosure is directed to a debris trap in a downspout. Using the debris trap of the present disclosure can provide an aesthetically pleasing debris trap that also allows a user to clean a clogged downspout quickly and easily. Additionally, the debris trap of the present disclosure can minimize debris falling below the debris trap during cleanout, which may result in clogging of a water storage and drainage system. The debris trap of the present disclosure can also minimize damage to the trap during cleanout, which could otherwise compromise the performance of the debris trap device.

In one aspect of the present disclosure, a debris trapping downspout includes a downspout having four sidewalls with a front sidewall and a rear sidewall. The front sidewall can define an opening that has an opening with a vertical extent along the downspout and a horizontal extent across a portion of the front sidewall. The debris trapping downspout can further include an angled grate having a top end secured to the rear sidewall at a first point, and a bottom end contacting the front sidewall at a second point lower than the first point. The angled grate can extend across an interior of the downspout at an angle between the first point and the second point with the bottom end contacting the front sidewall beneath the vertical extent of the opening. The debris trapping downspout can also include a baffle secured to the front sidewall in the interior of the downspout above the vertical extent of the opening. The baffle can extend across the horizontal extent of the opening and at least a portion of the vertical extent of the opening with the baffle angled inward relative to the front sidewall.

In another aspect of the present disclosure, a debris trap for catching debris in a downspout includes an angled grate having a top end secured to a rear of a downspout at a first point, and a bottom end secured to a front sidewall of the downspout at a second point lower than the first point. The angled grate can extend across an interior of the downspout at an angle between the first point and the second point. The angled grate can also have a series of holes configured to enable fluid to flow through the angled gate. The debris trap for catching debris in a downspout can further include a baffle having a top portion secured to the front sidewall of the downspout and a bottom portion extending inward toward the interior of the downspout at an angle relative to the front sidewall. The angled grate of the debris trap for catching debris can be located within an opening defined by the downspout with the bottom end secured to the front sidewall of the downspout below a vertical extent of the opening.

DETAILED DESCRIPTION

The following detailed description is exemplary in nature and is not intended to limit the scope, applicability, or configuration of the invention in any way. Rather, the following description provides some practical illustrations for implementing embodiments of the present invention. Examples of constructions, materials, and/or dimensions are provided for selected elements. Those skilled in the art will recognize that many of the noted examples have a variety of suitable alternatives.

Figure 1:
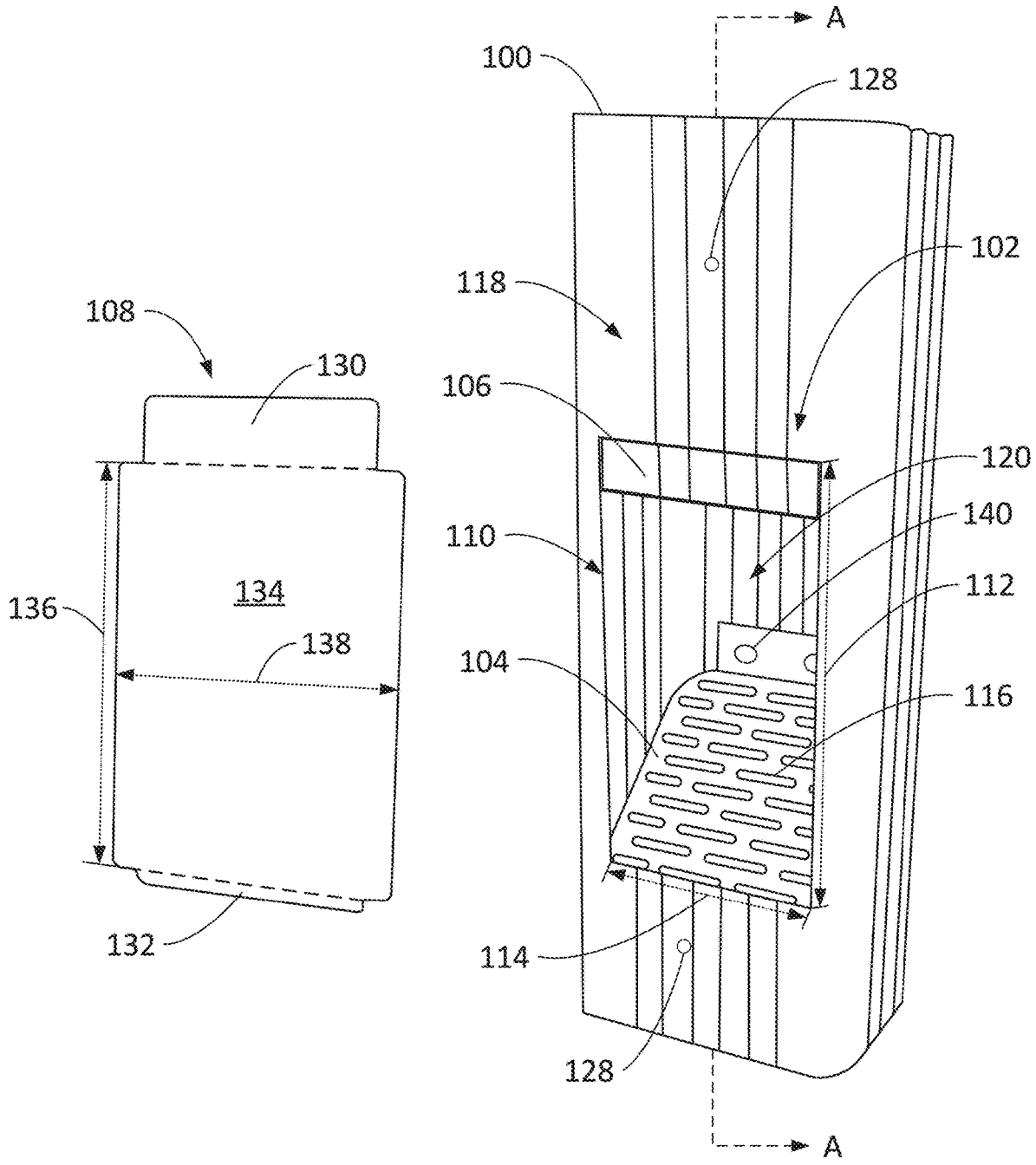
FIG. 1 is a perspective view of an example downspout with a debris trap including a cover piece according to an aspect of the present disclosure.

FIG. 1 is a perspective view of an example downspout 100 with a debris trap 102. The debris trap 102 includes an angled grate 104, a baffle 106, and a cover piece 108 according to an aspect of the present disclosure. The downspout defines an opening 110 that has a vertical extent 112 and a horizontal extent 114. The debris trap 102 is located in an interior of the downspout 100. The debris trap 102 is secured to the downspout 100 and in operation, allows fluids to flow through holes 116 of the angled grate 104 while catching debris such as leaves, twigs, or other objects larger than the holes 116. Additionally, the baffle 106 of the debris trap 102 directs fluids further inward in the interior of the downspout 100 and can help prevent fluid from leaking from the opening 110. The cover piece 108 can be removably secured to the downspout 100 and can cover the entire opening 110. The cover piece 108 can prevent fluid from splashing or leaking from the opening 110 of the downspout 100 and can be easily removed to clean debris from the debris trap 102.

The downspout 100 can be a part of a rain gutter system and can be formed from a single piece of material such as aluminum. The downspout 100 has four sidewalls including a front sidewall 118 and a rear sidewall 120. In some examples, to install the debris trap 102, an opening 110 can be cut into the downspout. The opening 110 can be cut in any sidewall but is preferably cut in either the front sidewall 118 or rear sidewall 120. The opening 110 of FIG. 1 is cut in the front sidewall 118 of the downspout. The opening 110 defined by the downspout has a vertical extent 112 and a horizontal extent 114. The vertical extent 112 extends vertically along the downspout while the horizontal extent 114 extends across the downspout. While the vertical extent 112 and horizontal extent 114 can have any measurements, in some examples, the vertical extent 112 of the opening 110 is between 3" and 8" long and the horizontal extent 114 of the opening 110 is between 2" and 4" wide. In some exemplary embodiments, the vertical extent 112 of the opening 110 is about 6" long and the horizontal extent 114 of the opening 110 is about 3.1" wide. In some examples, the horizontal extent 114 of the opening 110 can be limited by the width of the downspout 100.

Figure 2:
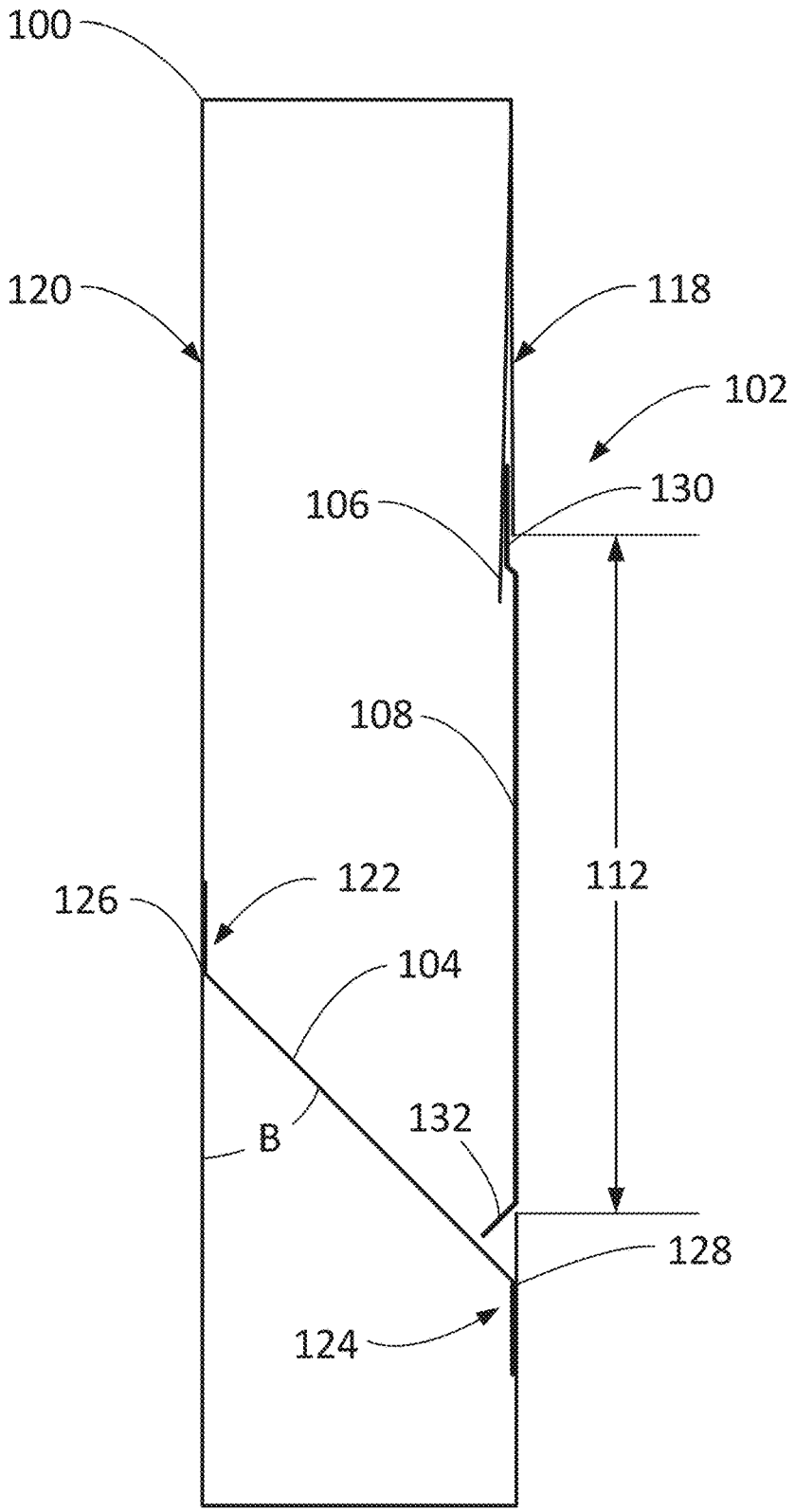
FIG. 2 is a cross-sectional view of the example downspout of FIG. 1 taken along the line "A" including the cover piece.

FIG. 2 is a cross-sectional view of the example downspout 100 of FIG. 1 taken along the line "A" including the cover piece 108. Referring to both FIG. 1 and FIG. 2, the debris trap 102 includes an angled grate 104. The angled grate 104 has a top end 122 and a bottom end 124. The top end 122 is secured to the rear sidewall 120 of the downspout at a first point 126 and the bottom end 124 is secured to the front sidewall 118 of the downspout at a second point 128. The second point 128 is vertically lower than the first point 126 and is beneath the front sidewall. The top end 122 and the bottom end 124 of the angled grate 104 extend along the sidewalls they are secured to and provide an area for securing means to secure the angled grate 104 to the downspout 100. In the illustrated example, the second point 128 is lower than the vertical extent 112 of the opening 110, leaving a portion of the front sidewall 118 of the downspout extending upward. This configuration can enable the cover piece 108 to removably secure to the downspout 100, as is discussed elsewhere herein, and can prevent water from splashing out or leaking from the opening 110.

In some examples, only one of the top end 122 or the bottom end 124 are secured to the downspout. For instance, in some examples, the top end 122 of the angled grate 104 secures to the rear sidewall 120 while the bottom end 124 only contacts the front sidewall. Alternatively, in some examples, the bottom end 124 of the angled grate 104 secures to the front sidewall 118 while the top end 122 only contacts the rear sidewall 120. In some examples, the angled grate can be secured to the other sidewalls of the downspout in addition to, or in lieu of being secured to the front and/or rear sidewalls.

The angled grate can be secured to any of the sidewalls via any securing means. Additionally, the baffle 106 can be secured to any of the sidewalls via any securing means. For instance, in the illustrated example of FIG. 1 and FIG. 2, the angled grate 104 is secured to the front and rear sidewalls 118, 120 and the baffle 106 is secured to the front sidewall via clinching (e.g., clinching points 140). Other methods of securing are contemplated including welding (e.g., spot welding), soldering, using fasteners (e.g., screws), and using adhesives (e.g., glue). Clinching can be advantageous over other methods, though, as clinching does not require penetration of material and can help prevent leaks from the securing means.

The angled grate 104 angles downward from the first point 126 to the second point 128. The angled grate 104 has an angle "B" defined between the angled grate 104 and the downspout 100. In some examples, the angle "B" is between 25 degrees and 65 degrees. However, in some exemplary embodiments, the angle "B" is approximately 45 degrees. Having the angled grate 104 at an angle relative to the downspout can be advantageous over having the angled grate orthogonal to the downspout as fluid that flows down the downspout 100 is less likely to splash out or leak from the debris trap. For instance, water that hits the angled grate 104 will be directed to the cover piece and subsequently run downward without splashing out of any seams.

Referring back to FIG. 1, the angled grate 104 includes holes 116. The holes 116 enable water or other fluids to flow through while debris or other foreign objects are caught and prevented from continuing down the downspout 100. The holes 116 are shaped to be oblong and are spaced regularly on the angled grate, though they need not be spaced regularly. The holes 116 have the same width but have varying lengths. In some examples, the holes have a width of approximately 0.15" (e.g., +/−0.05") and lengths between 0.50" and 1.25". In FIG. 1, the angled grate 104 has two different lengths of oblong holes with the smaller holes being approximately 0.60" in length and the larger holes being approximately 1.00" in length. While one example of the holes 116 is illustrated, a person having ordinary skill will appreciate that other hole shapes, sizes, patterns, locations etc. are contemplated and that this disclosure is not limited by the illustrated examples.

Referring to FIG. 1 and FIG. 2, the debris trap 102 includes a baffle 106. The baffle 106 is secured to the interior of the downspout 100 on the front sidewall 118 at a point above the opening 110. As described elsewhere herein, the baffle 106 can be secured to the downspout 100 via clinching (e.g., clinching point 140). The baffle 106 includes a portion that extends into the area behind the opening 110 and which extends across the horizontal extent 114 of the opening 110. The baffle 106 has a horizontal extent that is preferably greater than or equal to the horizontal extent 114 of the opening 110, though it need not be. The baffle 106 can have any vertical extent, however, in some examples the vertical extent of the baffle 106 is smaller than the vertical extent 112 of the opening 110 to allow the baffle to be inserted through the opening 110 for attachment to the front sidewall 118. The baffle can be made from the same material as the downspout 100 and in some examples, is made from the same piece of the downspout cut to form the opening 110.

As illustrated in the example of FIG. 2, the baffle 106 is angled inward relative to the front sidewall 118 of the downspout 100. The baffle 106 can be angled inward at any angle, but preferably is angled less than 15 degrees relative to the front sidewall of the downspout. In some examples, the baffle 106 is curved inward. By angling the baffle 106 inward, fluid that flows down the downspout 100, especially fluid that flows near or down the front sidewall 118, is directed inward away from the opening 110. Such a configuration can help prevent fluid from leaking from the opening.

Referring to FIG. 1 and FIG. 2, the debris trap 102 also includes a cover piece 108 that is removable. The cover piece 108 comprises a top flange 130 and a bottom flange 132 connected by a main portion 134. The main portion 134 has a vertical extent 136 and a horizontal extent 138 which cover the opening 110 when the cover piece 108 is secured to the downspout. The vertical extent 112 of the cover piece 108 is slightly smaller than the vertical extent 112 of the opening 110. However, the horizontal extent 138 of the main portion 134 of the cover piece 108 is larger than the corresponding horizontal extent 114 of the opening 110 of the downspout. Additionally, the horizontal extent of the top flange is slightly smaller than, or approximately equal to, the horizontal extent 114 of the opening 110. This configuration enables the opening 110 to be covered by the cover piece 108 while only having very small seams between the cover piece 108 and the downspout 100. Specifically, most of the opening 110 is covered by the area of the main portion 134 of the cover piece 108 with only a small portion of the opening 110 being covered by the top flange 130. In some examples, the horizontal extent of the top flange is slightly larger than horizontal extent 114 of the opening 110. In some examples, an inner surface of the main portion 134 of the cover piece 108 contacts an outer surface of the front sidewall 118 of the downspout 100 preventing water from leaking.

As seen in FIG. 2, the top flange 130 and the bottom flange 132 can be used to removably secure the cover piece 108 to the debris trap. The top flange 130 can be inserted between the baffle 106 and the front sidewall 118 of the downspout while the bottom flange can rest upon the angled grate 104 and/or the portion of the downspout 100 above the second point 128. The top flange 130 is in contact with both the baffle 106 and the front sidewall 118 of the downspout. Because the top flange 130 is in contact with the baffle 106 and extends above the opening 110, any water that flows off the baffle cannot leak from the top of the opening even accounting for the cohesive properties of water (e.g., water creeping upward).

The top flange 130 of the cover piece is bent inward relative to the main portion 134 of the cover piece 108 which can enable the top flange 130 to fit between the baffle 106 and the front sidewall 118 while keeping the main portion of the cover piece 108 in-line (e.g., flush) with the front wall of the downspout. The bottom flange 132 is also bent inward relative to the main portion 134 of the cover piece 108 which can enable the bottom flange 132 to rest on the angled grate 104 and/or the portion of the downspout 100 above the second point 128. Additionally, the bend of the bottom flange helps prevent fluid from hitting the angled grate 104, going under the cover piece 108, and leaking out of the opening 110.

In an example operation of securing the cover piece 108 to the downspout 100, the cover piece 108 is tilted such that the top flange 130 of cover piece 108 can be inserted between the baffle 106 and the front sidewall 118 of the downspout. In some examples, the cover piece 108 is tilted about its short axis and rotated about its long axis to insert the top flange 130. Next, the bottom flange 132 is directed inward toward the angled grate until the main portion 134 is approximately in line with the front sidewall 118. Next, the cover piece 108 is released, whereby it drops down and rests on the angled grate 104 and/or the portion of the downspout 100 above the second point 128.

Figure 3:
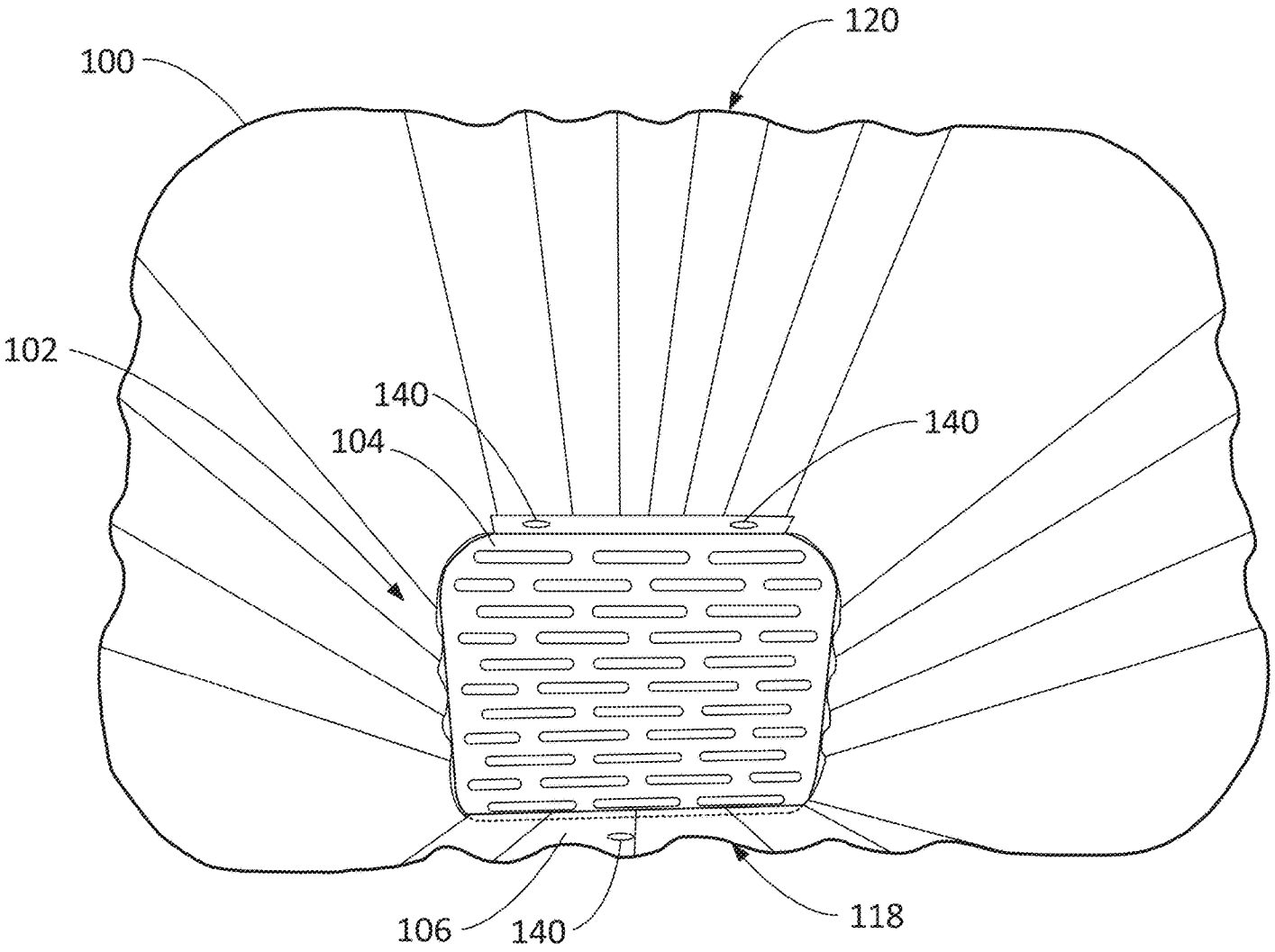
FIG. 3 is a top-down perspective view of the example downspout of FIG. 1 and FIG. 2 with a debris trap according to an aspect of the present disclosure.

Moving to FIG. 3, FIG. 3 is a top-down perspective view of the example downspout 100 of FIG. 1 and FIG. 2 with a debris trap 102 according to an aspect of the present disclosure. The debris trap 102 includes the angled grate 104, the baffle 106, and the cover piece 108 (obscured by baffle). The baffle 106 is angled inward and covers a portion of the angled grate 104 as illustrated by the dashed line. As discussed elsewhere herein, the baffle 106 can direct fluid flowing down the downspout 100 inward and away from the cover. The angled grate 104 is secured to the rear sidewall 120 by clinching points 140 and the baffle is secured to the front sidewall 118 by a clinching point 140.

In the illustrated example, the angled grate 104 fills nearly the entire interior portion of the downspout 100. Specifically, the angled grate 104 contacts all four sidewalls of the downspout 100 and covers nearly an entire cross-sectional area of the downspout 100. In some examples, some empty space exists between the edges of the angled grate 104 and the downspout 100. This empty space can be due to the edge of the angled grate not perfectly aligning with the bends in the downspout that are used for strengthening. However, in such examples, the empty space is smaller than the holes 116 of the angled grate 104 and prevents debris from flowing past the angled grate 104 while still enabling fluid to flow through the empty space. In some examples, the angled grate does not have empty space between it and the downspout. For instance, both the downspout and the angled grate can be round with the angled grate fit to the downspout without gaps.

Various embodiments of a debris trap for a downspout have been described. The various debris trap examples described can have several advantages over other debris traps. For instance, the cover piece is easily secured to, and removed from, the downspout, thereby enabling easier removal of built-up debris caught in the debris trap. Additionally, the baffle can both provide a securing means for the cover piece and prevent water from leaking from the top of the opening. Further, because the grate is angled instead of flat, it can direct splashing in one direction, toward the cover piece. As the cover piece can be a single piece of material, sits above a portion of the downspout, and has a bottom flange that is directed inward, the splashing fluid hitting the angled grate does not leak as much as other designs. Also, compared to debris trap designs that are slid in from the shorter sides of the downspout, the debris trap of the present disclosure is inserted and accessible from the larger side (e.g., front sidewall), enabling easier installation and maintenance (e.g., cleaning out debris).

Various examples have been described. These and other examples are within the scope of the following numbered embodiments.

The invention claimed is:

1. A debris trapping downspout comprising:

a downspout having four sidewalls including a front sidewall and a rear sidewall, the front sidewall defining an opening, the opening having a vertical extent along the downspout and horizontal extent across a portion of the front sidewall;

an angled grate having a top end secured to the rear sidewall at a first point and a bottom end contacting the front sidewall at a second point lower than the first point, the angled grate extending across an interior of the downspout at angle between the first point and the second point, the bottom end contacting the front sidewall beneath the vertical extent of the opening;

a baffle secured to the front sidewall in the interior of the downspout above the vertical extent of the opening, the baffle extending across the horizontal extent of the opening and at least a portion of the vertical extent of the opening, the baffle angled inward relative to the front sidewall; and a cover piece having a top flange and a bottom flange, the cover piece configured to removably cover the opening and secure to the downspout;

wherein the top flange of the cover piece is configured to insert between the baffle and the front sidewall of the downspout, and the bottom flange is configured to contact the interior of the downspout.

2. A debris trapping downspout comprising:

a downspout having four sidewalls including a front sidewall and a rear sidewall, the front sidewall defining an opening, the opening having a vertical extent along the downspout and horizontal extent across a portion of the front sidewall;

an angled grate having a top end secured to the rear sidewall at a first point and a bottom end contacting the front sidewall at a second point lower than the first point, the angled grate extending across an interior of the downspout at angle between the first point and the second point, the bottom end contacting the front sidewall beneath the vertical extent of the opening;

a baffle secured to the front sidewall in the interior of the downspout above the vertical extent of the opening, the baffle extending across the horizontal extent of the opening and at least a portion of the vertical extent of the opening, the baffle angled inward relative to the front sidewall; and a cover piece having a top flange and a bottom flange, the cover piece configured to removably cover the opening and secure to the downspout;

wherein a main portion of the cover piece is sized larger than the horizontal extent of the opening defined by the front sidewall; and the top flange and the bottom flange are sized smaller than the horizontal extent of the opening defined by the front sidewall.

3. The debris trapping downspout of claim 1, wherein the angle of the angled grate extends across the interior of the downspout at is approximately 45 degrees relative to vertical.

4. The debris trapping downspout of claim 1, wherein the angled grate has a series of oblong holes configured to permit fluid through.

5. The debris trapping downspout of claim 4, wherein each hole in the series of oblong holes is smaller than 0.20" in width and smaller than 1.25" in length.

6. The debris trapping downspout of claim 1, wherein the bottom end of the angled grate is secured to the front sidewall.

7. The debris trapping downspout of claim 1, wherein the angled grate is secured to the rear sidewall and the baffle is secured to the front sidewall via a clinching-type attachment.

8. The debris trapping downspout of claim 1, wherein the vertical extent of the opening is approximately 6" and the horizontal extent of the opening is approximately 3".

9. A debris trap for catching debris in a downspout comprising:

an angled grate having a top end secured to a rear sidewall of a downspout at a first point and a bottom end secured to a front sidewall of the downspout at a second point lower than the first point, the angled grate extending across an interior of the downspout at an angle between the first point and the second point, the angled grate having a series of holes configured to enable fluid to flow through the angled grate; and a baffle having a top portion secured to the front sidewall of the downspout and a bottom portion extending inward toward the interior of the downspout at an angle relative to the front sidewall; and a cover piece, the cover piece configured to cover the vertical extent and a horizontal extent of the opening, the cover piece having a top flange insertable between the baffle and the front sidewall and a bottom flange configured to contact the angled grate and/or the front sidewall of the downspout;

wherein the angled grate is located within an opening defined by the downspout with the bottom end secured to the front sidewall of the downspout below a vertical extent of the opening.

10. The debris trap of claim 9, wherein the cover piece is made from a single piece of material.

11. The debris trap of claim 9, wherein the top flange and the bottom flange are bent inward relative to a main portion of the cover piece.

12. The debris trap of claim 11, wherein the main portion of the cover piece has a horizontal extent larger than the horizontal extent of the opening and the top flange has a horizontal extent smaller than or equal to the horizontal extent of the opening.

13. The debris trap of claim 11, wherein the main portion of the cover piece has a vertical extent shorter than the vertical extent of the opening.

14. The debris trap of claim 9, wherein the top end of the baffle is secured to the front sidewall above the vertical extent of the opening.

15. The debris trap of claim 9, wherein the angled grate is angled relative to the downspout at an angle of approximately 45 degrees.

16. The debris trap of claim 9, wherein the series of holes are shaped to be oblong with a length greater than their width.

17. The debris trap of claim 16, wherein the series of holes are smaller than 0.20" in width and smaller than 1.25" in length.

18. The debris trapping downspout of claim 2, wherein the main portion of the cover piece is sized larger than the horizontal extent of the opening defined by the front sidewall; and the top flange and the bottom flange are sized smaller than the horizontal extent of the opening defined by the front sidewall.

19. The debris trapping downspout of claim 2, wherein the bottom end of the angled grate is secured to the front sidewall.

20. The debris trapping downspout of claim 2, wherein the angled grate is secured to the rear sidewall and the baffle is secured to the front sidewall via a clinching-type attachment.

* * * * *